US006747226B2

(12) United States Patent
Watanabe

(10) Patent No.: US 6,747,226 B2
(45) Date of Patent: Jun. 8, 2004

(54) ILLUMINATED SWITCH CONSTRUCTION AND PUSHBUTTON UNIT FOR ILLUMINATED SWITCHES

(75) Inventor: Tsutomu Watanabe, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/667,071

(22) Filed: Sep. 18, 2003

(65) Prior Publication Data

US 2004/0074751 A1 Apr. 22, 2004

(30) Foreign Application Priority Data

Sep. 20, 2002 (JP) ..... 2002-275454
Jul. 22, 2003 (JP) ..... 2003-200062

(51) Int. Cl.[7] ..... H01H 13/14

(52) U.S. Cl. ..... 200/520; 200/314; 200/341; 200/345

(58) Field of Search ..... 200/517, 520, 200/310, 313, 314, 292–296, 341, 345

(56) References Cited

U.S. PATENT DOCUMENTS 5,188,220 A * 2/1993 Schmitt-Walter ..... 200/313
5,252,798 A * 10/1993 Kamada ..... 200/314
5,543,594 A * 8/1996 Romero-Herrera ..... 200/314
5,777,281 A * 7/1998 Riddiford ..... 200/5 A
5,812,116 A * 9/1998 Malhi ..... 345/168
6,504,119 B1 * 1/2003 Ribeiro ..... 200/314
6,522,147 B1 * 2/2003 Pickard et al. ..... 200/314

FOREIGN PATENT DOCUMENTS

JP 60-162326 10/1985
JP 4-269412 9/1992
JP 9-022634 1/1997

* cited by examiner

*Primary Examiner*—Michael A. Friedhofer
(74) *Attorney, Agent, or Firm*—Morrison & Foerster LLP

(57) ABSTRACT

There is provided an illuminated switch construction, which make it possible to ensure excellent visibility and operability of the illuminated switch, while the illuminated switch can be compact in size, cost-reduced and simple in structure. A substrate is formed therein with a plurality of guide holes. A switch unit and an LED are arranged on the substrate at locations adjacent to each other. The switch unit has a driven part driven for reciprocating motion. A pushbutton unit is formed by a diffuser sheet and a button body which are stacked one upon the other on a lamp house. A plurality of guide pins extend from the lamp house and are fitted through the respective guide holes. The lamp house has a fitting part formed therein with a fitting hole in which a head part of the driven part of the switch unit is fitted and held. When a depressing part of the button body is depressed, the pushbutton unit performs reciprocating motion in a manner interlocked with the driven part. The guide pins slide within the respective guide holes, whereby the reciprocating motion of the pushbutton unit is guided.

21 Claims, 8 Drawing Sheets

ILLUMINATED SWITCH CONSTRUCTION AND PUSHBUTTON UNIT FOR ILLUMINATED SWITCHES

BACKGROUND OF THE INVENTION

1. Field of the Invention

The present invention relates to an illuminated switch construction which is applied to various electronic devices and apparatuses such as a mixer, and a pushbutton unit for illuminated switches.

2. Description of the Related Art

Conventionally, illuminated switches e.g. of a push type are widely used as operating elements in mixers, electronic musical instruments, and other electronic devices and apparatuses. The push-type illuminated switches include a type which is provided with a depressing part formed of a transparent member, and an associated light-emitting part formed e.g. of an LED (Light Emitting Diode) so as for the depressing part to exhibit a higher quality appearance than that of an illuminated switch having a depressing part formed of rubber or the like. When the depressing part is operated, the associated light-emitting part emits light, which can be seen through the transparent depressing part.

In an illuminated switch of the above-mentioned type, a commercially available switch unit is used, for example, which includes a reciprocating driven part and is turned on and off by depression of the driven part. However, if the light-emitting part is disposed at a location upward of the driven part of the switch unit, the size of the whole illuminated switch is increased. A switch unit with an LED is also available, but it is expensive. For these reasons, in illuminated switches disclosed in first to third prior art documents, mentioned below, a light-emitting slightly spaced from a switch unit.

More specifically, in an illuminated switch construction disclosed in the first prior art document (Japanese Laid-Open Utility Model Publication (Kokai) No. 60-162326), an operating element is fixedly fitted in a driven part of a push switch, and light from a light-emitting diode is seen through a hole formed in the operating element (see e.g. FIG. 3 of the publication).

In an illuminated switch construction disclosed in the second prior art document (Japanese Laid-Open Patent Publication (Kokai) No. 4-269412), an operating element is held and guided by a frame for the operating element, which is fixed to an operating panel, and light from a light-emitting diode is visually recognized through a lens body (see e.g. FIG. 15 of the publication).

Further, in an illuminated switch construction disclosed in the third prior art document (Japanese Laid-Open Patent Publication (Kokai) No. 9-22634), a substrate and a sub panel are connected to each other, and a guide frame is mounted on the sub panel such that an operator part is held and guided by the guide frame. The operator part is elongated so as to contain a light-emitting diode and a switch (see e.g. FIGS. 1 and 2 of the publication).

In the illuminated switch construction disclosed in the first prior art document, however, the operating element is held only by the driven part of the push switch, which makes the operating element unstable. Therefore, the illuminated switch is not satisfactory in operability and durability, and its switching operation is not stable. On the other hand, in the illuminated switch constructions disclosed in the second and third prior art documents, since the operating element or the operator part is held and guided by the frame for the operating element or the guide frame, the switching operation of the illuminated switch is stable. However, a holding mechanism having the frame is additionally needed, which makes the construction complicated and causes an increase in the size and manufacturing costs of the illuminated switch. Further, in the construction disclosed in the third prior art document, since the operator part is elongated, the operation of the illuminated switch is unstable depending the position at which the switch is operated, which degrades the operability of the switch. As for emitted light, needless to say, it is preferred that the light can be visually recognized with ease.

SUMMARY OF THE INVENTION

It is a first object of the present invention to provide an illuminated switch construction and a pushbutton unit for illuminated switches, which make it possible to ensure excellent visibility and operability of the illuminated switch, while the illuminated switch can be compact in size, cost-reduced and simple in structure.

It is a second object of the present invention to provide an illuminated switch construction which makes it possible to realize excellent operability and smooth switching operation of the illuminated switch, while the illuminated switch can be compact in size, cost-reduced and simple in structure.

To attain the above first object, in a first aspect of the present invention, there is provided an illuminated switch construction comprising a substrate having at least one guide hole formed therein, a switch unit provided on the substrate, the switch unit having a driven part driven for reciprocating motion, a light-emitting device provided on the substrate at a location adjacent to the switch unit, and a pushbutton that drives the switch unit, the pushbutton unit having an opposed part disposed in opposed relation to the light-emitting device, a depressing part disposed in association with the opposed part, for depressing operation, the depressing part allowing light from the light-emitting device to pass therethrough, a coupling part coupled to the driven part of the switch unit to interlock the driven part and the pushbutton unit for reciprocating motion, and at least one guide pin fitted through a corresponding one of the at least one guide hole of the substrate to cooperate with the corresponding guide hole to perform a guiding function of guiding the reciprocating motion of the pushbutton unit.

With the illuminated switch construction according to the first aspect of the present invention, since the depressing part is disposed in association with the opposed part disposed in opposed relation to the light-emitting part, when the depressing part is depressed, light transmitted from the light-emitting part passes through the depressing part, so that the operator can clearly recognize the light through the depressing part. Further, since the coupling part of the pushbutton unit is coupled with the driven part of the switch unit to interlock the driven part and the pushbutton unit for reciprocating motion, and the guide pin(s) fitted through the guide hole(s) of the substrate cooperate(s) with the guide hole(s) to perform the guiding function of guiding reciprocating motion of the pushbutton unit, it is not necessary to additionally provide a large-sized holding member, such as a guide frame, for holding and guiding the pushbutton unit. This makes it possible to make the illuminated switch simple in structure, suppress an increase in size and costs, and maintain operability of the depressing part. Therefore, it is possible to ensure excellent visibility and operability, while being compact in size, cost-reduced and simple in structure.

Preferably, the switch unit has a vertical surface substantially perpendicular to the substrate, and the pushbutton unit has a sliding contact part that is disposed for sliding contact with the vertical surface of the switch unit in accordance with the reciprocating motion of the pushbutton unit, the vertical surface of the switch unit and the sliding contact part of the pushbutton unit cooperating with each other to perform the guiding function together with the guide hole and the guide pin, for guiding the reciprocating motion of the pushbutton unit.

To attain the above first object, in a second aspect of the present invention, there is provided a pushbutton unit for an illuminated switch fixed on a substrate having at least one guide hole formed therein, the pushbutton unit being operated for driving a switch unit having a driven part that is driven for reciprocating motion, comprising an opposed part disposed in opposed relation to a light-emitting device provided on the substrate at a location adjacent to the switch unit, a depressing part disposed in association with the opposed part, for depressing operation, the depressing part allowing light from the light-emitting device to pass therethrough, a coupling part coupled to the driven part of the switch unit to interlock the driven part and the pushbutton unit for reciprocating motion, and at least one guide pin fitted through a corresponding one of the at least one guide hole of the substrate to cooperate with the corresponding guide hole to perform a guiding function of guiding the reciprocating motion of the pushbutton unit.

With the arrangement of the pushbutton unit for an illuminated switch according to the second aspect of the present invention, it is possible to ensure excellent visibility and operability, while being compact in size, cost-reduced and simple in structure.

Preferably, the pushbutton unit further comprises a sliding contact part disposed for sliding in contact with a vertical surface of the switch unit in accordance with the reciprocating motion of the pushbutton unit, and the sliding contact part cooperates with the vertical surface to perform the guiding function together with the guide hole and the guide pin, for guiding the reciprocating motion of the pushbutton unit.

To attain the above first object, in a third aspect of the present invention, there is provided an illuminated switch construction comprising a substrate having at least one guide part, a switch unit provided on the substrate, the switch unit having a driven part that is driven for reciprocating motion, a light-emitting device provided on the substrate at a location adjacent to the switch unit, and a pushbutton unit that drives the switch unit, the pushbutton unit having an opposed part disposed in opposed relation to the light-emitting device, a depressing part disposed in association with the opposed part, for depressing operation, the depressing part allowing light from the light-emitting device to pass therethrough, a coupling part coupled to the driven part of the switch unit to interlock the driven part and the pushbutton unit for reciprocating motion, and at least one guide-engaging part engaged with a corresponding one of the at least one guide part of the substrate to cooperate with the corresponding guide part to perform a guiding function of guiding the reciprocating motion of the pushbutton unit.

With the illuminated switch construction according to the third aspect of the present invention, it is possible to make the illuminated switch simple in structure, suppress an increase in size and costs, and maintain operability of the depressing part. Therefore, it is possible to ensure excellent visibility and operability of the illuminated switch, while the illuminated switch can be compact in size, cost-reduced and simple in structure.

Preferably, the illuminated switch construction further comprises at least one guide pin provided on the guide-engaging part, and the guide part has at least one through hole formed therein and extending in a longitudinal direction of the at least one guide pin of the guide-engaging part, the guide pin being fitted through the at least one through hole, the guide part being formed as a separate member from the substrate and fixed to the substrate.

To attain the above first object, in a fourth aspect of the present invention, there is provided an illuminated switch construction comprising a substrate having at least one guide part, a switch unit provided on the substrate, the switch unit having a driven part that is driven for reciprocating motion, a light-emitting device provided on the substrate at a location adjacent to the switch unit, and a pushbutton unit that drives the switch unit, the pushbutton unit having a pushbutton unit main body and a push-down member with indicator, and the pushbutton unit main body being formed as a one-piece member incorporating an opposed part disposed in opposed relation to the light-emitting device, a coupling part coupled to the driven part of the switch unit to interlock the driven part and the pushbutton unit for reciprocating motion, and at least one guide-engaging part engaged with a corresponding one of the at least one guide part of the substrate to cooperate with the corresponding guide part to perform a guiding function of guiding the reciprocating motion of the pushbutton unit, the push-down member with indicator being disposed on a side of the pushbutton unit main body remote from the substrate and in association with the opposed part of the pushbutton unit main body, the push-down member with indicator having a depressing part for depressing operation, the depressing part allowing light from the light-emitting device to pass therethrough.

With the illuminated switch construction according to the fourth aspect of the present invention, it is possible not only to make the illuminated switch simple in structure, and suppress an increase in size and costs, but also to maintain operability of the push-down member with indicator. Therefore, it is possible to ensure excellent visibility and operability of the illuminated switch, while the illuminated switch can be compact in size, cost-reduced and simple in structure.

Preferably, the push-down member with indicator includes at least one light diffuser sheet.

Preferably, the push-down member with indicator is formed by the light diffuser sheet and the depressing part stacked upon the light diffuser sheet on the side of the pushbutton unit main body remote from the substrate.

Preferably, the depressing part composed of a solid transparent body.

Preferably, the illuminated switch construction further comprises at least one positioning engaging part provided on the pushbutton unit main body, for aligning the light diffuser sheet and the depressing part stacked upon the light diffuser sheet.

To attain the above first object, in a fifth aspect of the present invention, there is provided an illuminated switch construction comprising a substrate having at least one guide part, a switch unit provided on the substrate, the switch unit having a driven part that is driven for reciprocating motion, a light-emitting device provided on the substrate at a location adjacent to the switch unit, and a pushbutton unit that drives the switch unit, the pushbutton unit being formed by a combination of a pushbutton unit main body and a push-down member with indicator, the pushbutton unit main body being formed as a one-piece member incorporating an opposed part disposed in opposed relation to the light-emitting device, a coupling part coupled to the driven part of the switch unit to interlock the driven part and the pushbutton unit for reciprocating motion, at least one guide-engaging part engaged with a corresponding one of the at least one guide part of the substrate to cooperate with the corresponding guide part to perform a guiding function of guiding the reciprocating motion of the pushbutton unit, and a push-down member-mounting part on which one of a plurality of types of push-down member with indicator can be selectively mounted on a side of the pushbutton unit main body remote from the substrate, the push-down member with indicator being disposed on the side of the pushbutton unit main body remote from the substrate and in association with the opposed part of the pushbutton unit main body, the push-down member with indicator having a depressing part for depressing operation, the depressing part allowing light from the light-emitting device to pass therethrough, wherein a desired one of the plurality of types of push-down member with indicator is mounted on the push-down member-mounting part of the pushbutton unit main body, thereby forming one of different types of illuminated switch assemblies.

With the illuminated switch construction according to the fifth aspect of the present invention, it is possible to ensure excellent visibility and operability of the illuminated switch, while the illuminated switch can be compact in size, cost-reduced and simple in structure. Further, by mounting a desired type of push-down member with indicator on the push-down member-mounting part of the pushbutton unit main body, a different type of illuminated switch assembly can be formed, so that it is possible to obtain numerous types of illuminated switch assemblies using a limited number of component parts.

Preferably, the push-down member with indicator further comprises at least one of a plurality of types of light diffuser sheets, whereby a plurality of types of the push-down member with indicator can be obtained by selectively combining at least one of the plurality of types of light diffuser sheets with the depressing part, and the selected at least one light diffuser sheet and the depressing part are mounted on the push-down member-mounting part of the pushbutton unit main body in a manner such that the selected at least one light diffuser sheet is stacked upon the depressing part, whereby a desired type of illuminated switch assembly can be obtained.

Preferably, the push-down member with indicator further comprises at least one light diffuser sheet, whereby a plurality of types of the push-down member with indicator can be obtained by selectively combining one of a plurality of types of depressing parts with the at least one light diffuser sheet, and the at least one light diffuser sheet and the selected depressing part are mounted on the push-down member-mounting part of the pushbutton unit main body in a manner such that the at least one light diffuser sheet is stacked upon the selected depressing part, whereby a desired type of illuminated switch assembly can be obtained.

Preferably, the push-down member with indicator further comprises at least one of a plurality of types of light diffuser sheets, whereby a plurality of types of the push-down member with indicator can be obtained by selectively combining one of a plurality of types of depressing parts and at least one of the plurality of types of light diffuser sheets, and the at least one light diffuser sheet and the selected depressing part are mounted on the push-down member-mounting part of the pushbutton unit main body in a manner such that the selected at least one light diffuser sheet is stacked upon the selected depressing part, whereby a desired type of illuminated switch assembly can be obtained.

Preferably, the pushbutton unit main body comprises side walls, and the opposed part comprises a cavity surrounded by the side walls.

More preferably, the cavity expands toward the push-down member with indicator.

More preferably, the depressing part and the cavity are disposed such that when during reciprocating motion of the pushbutton unit responsive to depression of the depressing part, at least a portion of the light-emitting device is inserted into the cavity, and as the depressing part is depressed deeper, the light-emitting device is inserted into the cavity to a greater degree.

To attain the above first object, in a sixth aspect of the present invention, there is provided an illuminated switch construction comprising a substrate having a plurality of electric components arranged thereon, at least one guide part fixed on the substrate, a switch unit provided on the substrate, the switch unit having a driven part that is driven for reciprocating motion, a light-emitting device provided on the substrate at a location adjacent to the switch unit, and a pushbutton unit that drives the switch unit, the pushbutton unit having a light transmissive part allowing light from the light-emitting device to pass therethrough, a depressing part for depressing operation, a coupling part coupled to the driven part of the switch unit to interlock the driven part and the pushbutton unit for reciprocating motion, at least one guide-engaging part engaged with a corresponding one of the at least one guide part of the substrate to cooperate with the corresponding guide part to perform a guiding function of guiding the reciprocating motion of the pushbutton unit, wherein reciprocating motion of the driven part is guided by the guiding function performed by the guide part and the guide-engaging part.

With the illuminated switch construction according to the sixth aspect of the present invention, it is possible to ensure excellent visibility and operability of the illuminated switch, while the illuminated switch can be compact in size, cost-reduced and simple in structure. Further, the guiding function performed by the guide part and the guide-engaging part makes it possible to achieve smooth switching operation.

To attain the above second object, in a seventh aspect of the present invention, there is provided a switch construction comprising a substrate having at least one guide part, a switch unit provided on the substrate, the switch unit having a driven part that is driven for reciprocating motion, and a pushbutton unit that drives the switch unit, the pushbutton unit having a depressing part for depressing operation, a coupling part coupled to the driven part of the switch unit to interlock the driven part and the pushbutton unit for reciprocating motion, and at least one guide-engaging part engaged with a corresponding one of the at least one guide part of the substrate to cooperate with the corresponding guide part to perform a guiding function of guiding the reciprocating motion of the pushbutton unit, the substrate comprising a general-purpose substrate used as a base member for a plurality of electric component parts other than the switch unit, the general-purpose substrate being capable of having the electric component parts and the pushbutton unit arranged thereon, wherein reciprocating motion of the driven part is guided by the guiding function performed by the guide part and the guide-engaging part.

With the arrangement of the switch construction according to the seventh aspect of the present invention, since the coupling part of the pushbutton unit is coupled with the driven part of the switch unit to interlock the driven part and the pushbutton unit for reciprocating motion, and the guide part and the guide-engaging part cooperate to perform the guiding function of guiding reciprocating motion of the pushbutton unit, it is not necessary to additionally provide a large-sized holding member, such as a guide frame, for holding and guiding the pushbutton unit. This makes it possible to make the illuminated switch simple in structure, suppress an increase in size and costs, and maintain operability of the depressing part. Further, since the substrate comprises a general-purpose substrate, the construction of the illuminated switch is simple and low in cost. Moreover, due to the guiding function performed by the guide part and the guide-engaging part, the reciprocating motion of the driven part is properly guided, ensuring smooth switching operation. Therefore, it is possible to ensure excellent visibility and operability of the illuminated switch, while the illuminated switch can be compact in size, cost-reduced and simple in structure.

To attain the above first object, in an eighth aspect of the present invention, there is provided an illuminated switch construction comprising a substrate having at least one guide pin fixed thereon, a switch unit provided on the substrate, the switch unit having a driven part driven for reciprocating motion, a light-emitting device provided on the substrate at a location adjacent to the switch unit, and a pushbutton unit that drives the switch unit, the pushbutton unit having an opposed part disposed in opposed relation to the light-emitting device, a depressing part disposed in association with the opposed part, for depressing operation, the depressing part allowing light from the light-emitting device to pass therethrough, a coupling part coupled to the driven part of the switch unit to interlock the driven part and the pushbutton unit for reciprocating motion, and at least one guide hole having a corresponding one of the at least one guide pin fitted therethrough, for cooperating with the corresponding guide hole to perform a guiding function of guiding the reciprocating motion of the pushbutton unit.

With the illuminated switch construction according to the eighth aspect of the present invention, it is possible to ensure excellent visibility and operability of the illuminated switch, while the illuminated switch can be compact in size, cost-reduced and simple in structure.

The above and other objects, features, and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
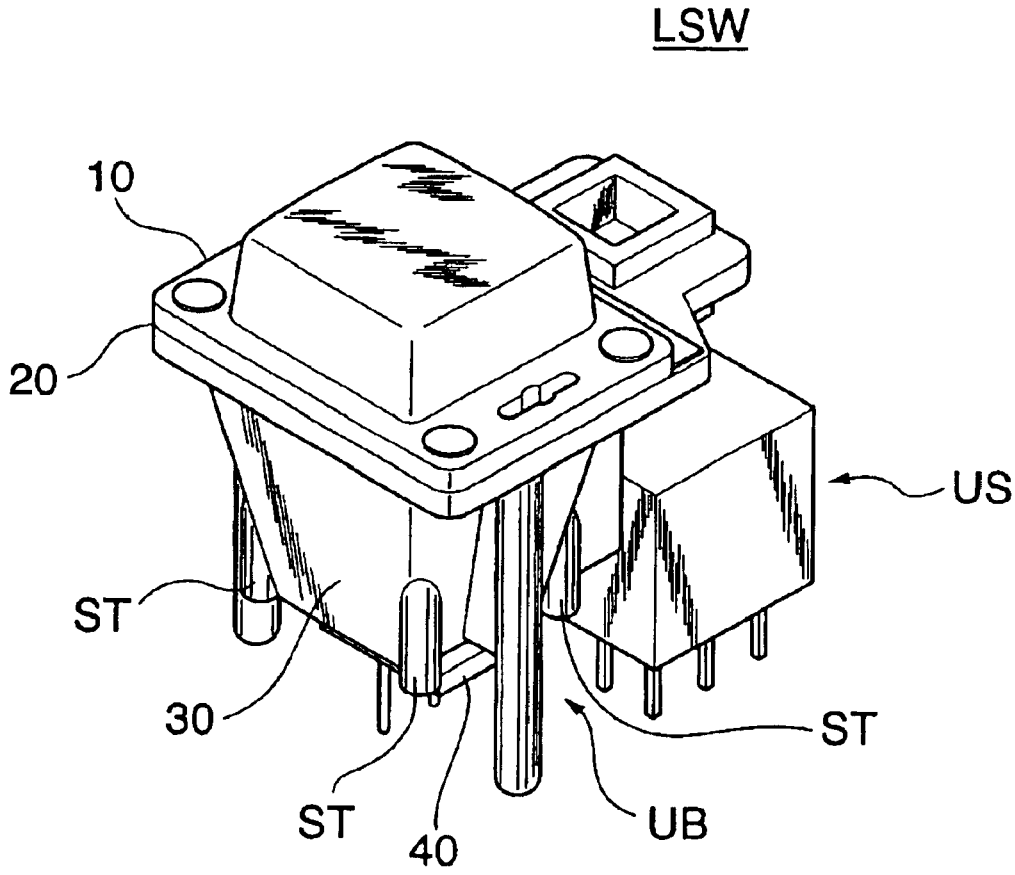
FIG. 1 is a perspective view showing the appearance of an illuminated switch having an illuminated switch construction according to a first embodiment of the present invention.

FIG. 1 is a perspective view showing the appearance of an illuminated switch having an illuminated switch construction according to a first embodiment of the present invention. The illuminated switch LSW is comprised of a switch unit US, a pushbutton unit UB, and an LED (Light Emitting Diode) 40. The pushbutton unit UB is operated to actuate the switch unit US, and is comprised of a button body 10, a diffuser sheet 20, and a lamp house 30. The illuminated switch LSW is suitable for use as a switch which is widely used in e.g. electronic devices and apparatuses, such as a mixer, and whose on/off operations are recognized from turning-on/off of a light emitter thereof.

Figure 2:
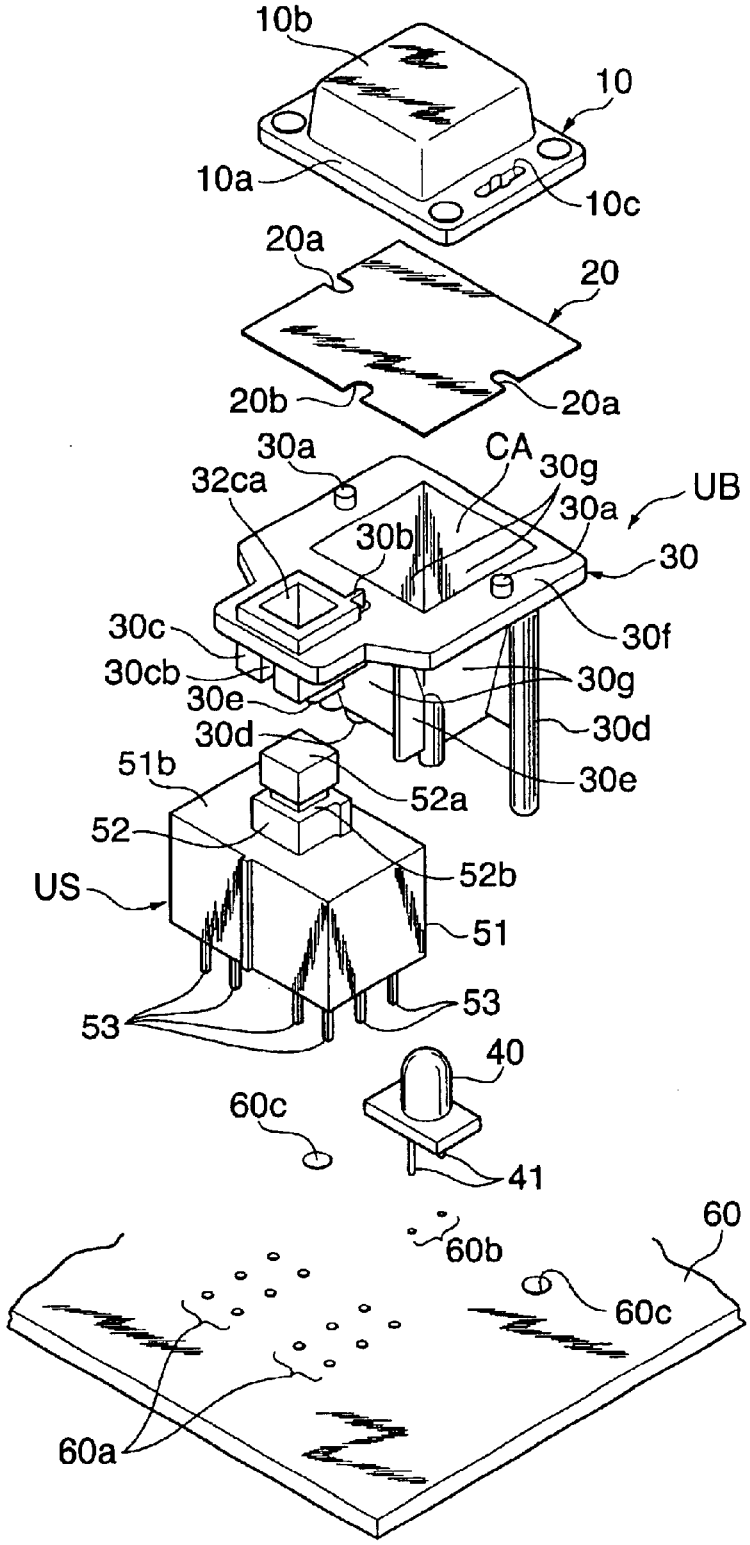
FIG. 2 is an exploded perspective view of the illuminated switch.
Figure 3A:
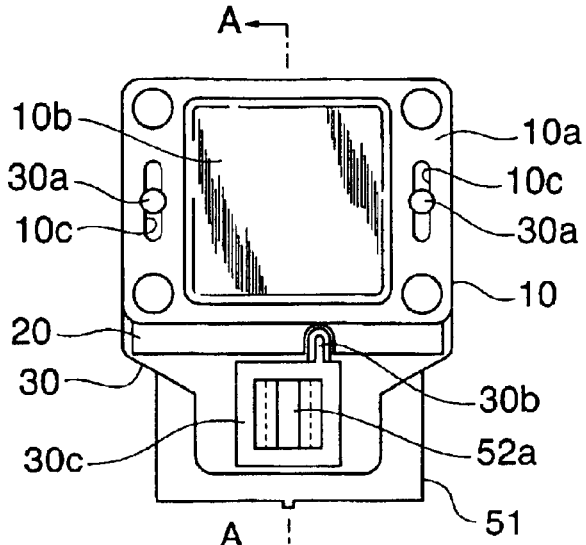
FIG. 3A is a top plan view of the illuminated switch.
Figure 3B:
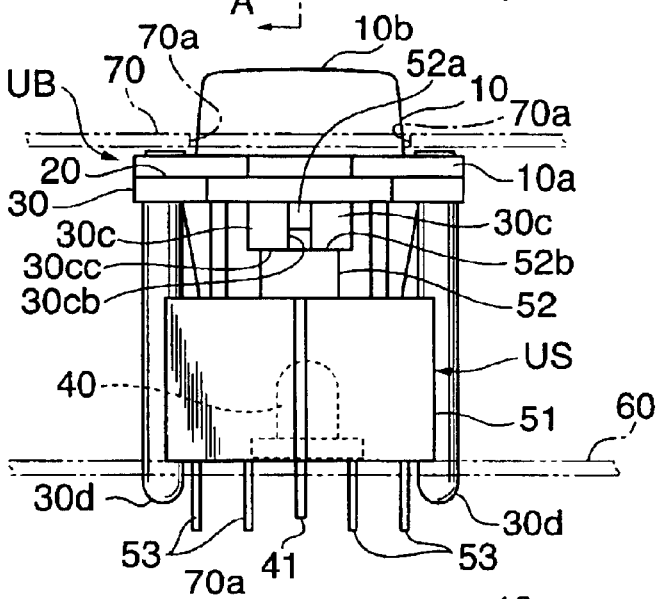
FIG. 3B is a front view of the illuminated switch as viewed from a switch unit side.
Figure 3C:
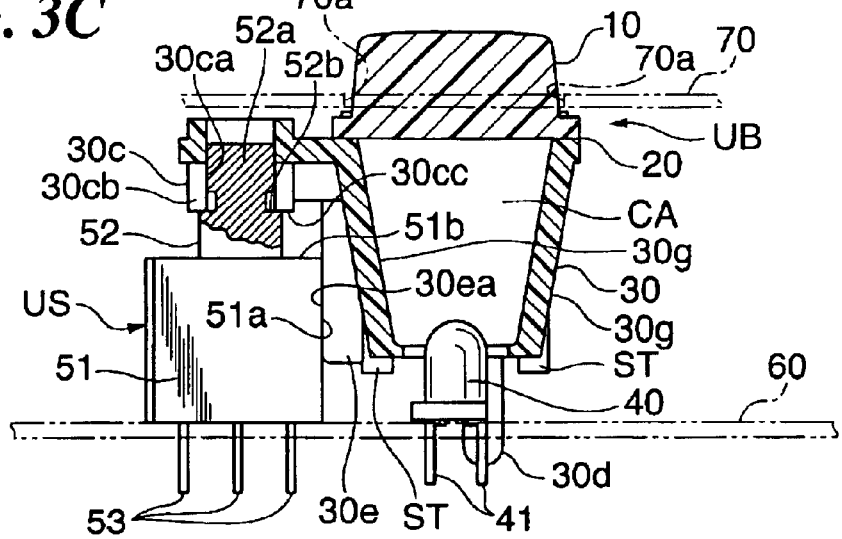
FIG. 3C is a cross-sectional view taken on line A—A in FIG. 3A.

FIG. 2 is an exploded perspective view of the illuminated switch LSW. FIGS. 3A to 3C are views showing details of the construction of the illuminated switch LSW, in which FIG. 3A is a top plan view of the illuminated switch LSW, FIG. 3B is a front view of the illuminated switch LSW as viewed from a switch unit US side, and FIG. 3C is a cross-sectional view taken on line A—A in FIG. 3A. As described in detail hereinbelow, the illuminated switch LSW is mounted on a substrate 60, and an operation of turning on the switch LSW causes the LED 40 to emit light, which is seen through the button body 10.

As shown in FIG. 2, the substrate 60 is formed therein with a plurality of terminal holes 60*a*, 60*b* and guide holes (guide parts) 60*c* arranged for each illuminated switch LSW. The substrate 60 can be implemented by a general-purpose substrate on which various electric component parts can be arranged. The terminal holes 60*a* correspond in number and location to the number and locations of terminals 53, referred to hereinafter, of the switch unit US. The LED 40 has two terminals 41, and the terminal holes 60*b* are arranged at respective two locations corresponding to the locations of the terminals 41 of the LED 40. The guide holes 60*c* are arranged at respective two locations corresponding to two guide pins (guide-engaging parts) 30*d*, referred to hereinafter, of the lamp house 30, and are each formed to have a shape which allows the corresponding guide pin 30*d* to be slidably inserted therethrough.

In the present embodiment, the switch unit US is implemented by a commercially available one. The switch unit US has a rectangular parallelepiped switch body 51 from which the twelve terminals 53 extend vertically downward, and a driven part 52 projecting upward from a central portion of an upper surface 51*b* of the switch body 51. Responsive to a depressing operation, the driven part 52 moves forward or backward relative to the switch body 51, and changes in position between a predetermined protruding position corresponding to an OFF state and a predetermined retracting position corresponding to an ON state whenever it is operated. The driven part 52 is formed e.g. of a synthetic resin, and has a head part 52*a* and a contact surface 52*b*.

The LED 40 and the switch unit US are provided on the substrate 60 in a side-by-side arrangement as shown in FIGS. 3B, 3C. More specifically, the two terminals 41 of the LED 40 extend through the respective corresponding terminal holes 60*b*, and the twelve terminals 53 of the switch unit US extend through the respective corresponding terminal holes 60*a*. The terminals 41, 53 each project downward from the substrate 60.

The button body 10 is a one-piece member formed e.g. of a transparent synthetic resin and is comprised of a base part 10*a* and a depressing part 10*b* (see FIG. 2, FIG. 3B). The depressing part 10*b* forms a button part to be directly touched and depressed by an operator. The base part 10*a* is formed therein with two slots 10*c* (see FIG. 3A). The slots 10*c* each have a substantially central portion thereof cut out to present a circular shape corresponding to the cross-sectional shape of a projection 30*a* as a positioning engaging part, referred to hereinafter, of the lamp house 30. The diffuser sheet 20 is formed e.g. of a translucent synthetic resin which allows transmission of light and at the same time causes diffused reflection of light. It is possible to print on the diffuser sheet 20 characters representing a function name, such as "ON", in association with the intended function of the illuminated switch LSW (see FIG. 6). The diffuser sheet 20 is formed with two cutouts 20*a* and a single cutout 20*b* (see FIG. 2).

The button body 10 and the diffuser sheet 20 form a "push-down member with indicator". In this case, by preparing a plurality of types or shapes of button bodies 10 and diffuser sheets 20 and selectively combining the button bodies 10 and the diffuser sheets 20 according to apparatus models or the like, it is possible to obtain different types of "push-down members with indicators". Further, by attaching each of these "push-down members with indicators" to a lamp house 30, it is possible to easily obtain different types of illuminated switch assemblies (illuminated switches LSW of the present embodiment). For example, if different types of diffuser sheets 20 are combined with button bodies 10 of one type, switches of one type having different function names can be obtained with ease. Conversely, if different types of button bodies 10 are combined with diffuser sheets 20 of one type, switches of different types or shapes for the same function can be obtained with ease. If the types of the button body 10 and the diffuser sheet 20 are numerous, the number of combinations can be remarkably increased, which makes it possible to obtain numerous types of switch assemblies with a reduced number of component parts, thereby contributing to reduction of manufacturing costs. An indication printed on each diffuser sheet 20 are not limited to letters, but different colors can be used on respective types of diffuser sheets 20. The use of different colors is suitable for unifying the color of a group of switches used for each channel or each channel group in a mixer, for example.

In the above cases, it is easy to commonly use the lamp house 30 for many types of switches. For example, button bodies 10 may be formed to present a cylindrical shape or a triangular prismatic shape, or a columnar shape which looks like a musical instrument, such as a grand piano, in plan view, while the same type of lamp house 30 may be commonly used for switches of different apparatus models, or for different switches of the same apparatus models. In this case, it is not necessary to form the entire button body 10 into such a shape, but only necessary to form the depressing part 10*b* into a required shape. Alternatively, the upper half of the depressing part 10*b*, which projects from a hole 70*a* (see FIGS. 3B, 3C) of a panel 70, referred to hereinafter, may be configured to have such a shape. In this case, if the shape of a portion of the illuminated switch LSW hidden below the hole 70*a* is the same as the shape appearing in FIG. 1, dies for manufacturing the illuminated switch LSW can be partially commonly used for forming different shapes button bodies 10.

Application of the pushbutton unit UB to switches having different functions can be realized by using diffuser sheets 20 having the respective function names printed thereon. Similarly, different colors may be used for the color of the button body 10.

Further, a single illuminated switch may use two or more diffuser sheets 20 placed one upon another. In this case, by printing a letter string on one diffuser sheet 20 and providing a color on another diffuser sheet 20, it is possible to further increase the variety of combinations of component parts of the illuminated switch LSW. Alternatively, one diffuser sheet 20 may have a letter string, such as "group", printed thereon and another may have a different letter string, such as "ensemble", printed thereon at a location that does not overlap the letter string "group" on the one diffuser sheet 20 when the two diffuser sheets 20 are placed one upon the other. By using such sheets separately or in combination, it is possible to obtain an increased number of indications using a limited number of diffuser sheets 20.

The lamp house 30 functions as a main body of the pushbutton unit UB, and is a one-piece member formed of a synthetic resin e.g. of white color. As shown in FIG. 2, the lamp house 30 has an upper surface (push-down member-mounting part) 30*f* from which the two projections 30*a* and a single projection 30*b* project upward. The diffuser sheet 20 is placed on the upper surface 30*f* of the lamp house 30, and the button body 10 is placed on the diffuser sheet 20. In this stacked arrangement, the diffuser sheet 20 is protected by the button body 10. The projections 30*a* are associated with the cutouts 20*a* of the diffuser sheet 20 and the slots 10*c* of the button body 10. The projections 30*a* are each fitted in the associated cutout 20*a* and slot 10*c* to thereby position the diffuser sheet 20 and the button body 10 in place. The projection 30*b* is associated with the cutout 20*b* of the diffuser sheet 20, and prevent the diffuser sheet 20 from being mounted with its surface and back reversed, or prevent an improper type of diffuser sheet 20 from being erroneously mounted when there exist a plurality of types of diffuser sheets 20, for example. Thus, stacking of the diffuser sheet 20 and the button body 10 is facilitated.

In the present embodiment, the projections 30*a* are formed at symmetrical locations on the upper surface 30*f*, but if the projections 30*a*, the cutouts 20*a* and the slots 10*c* are formed at respective asymmetrical locations, the projection 30*b* and the cutout 20*b* for preventing erroneous mounting can be omitted. Further, the projections 30*a* may be formed at such locations that the lamp house 30 can be commonly used for different apparatus models using different types of button bodies 10 and diffuser sheets 20. For example, projections 30*a* are formed at a plurality of locations such that a plurality of mounting position patterns are provided for mounting the different types of button bodies 10 and diffuser sheets 20 at respective different locations, whereby the lamp house 30 can be compatible with a number of types of switches.

When the projection 30*a* is fitted in the slot 10*c* of the button body 10, the slot 10*c* is slightly widened, and then its resilience brings the button body 10 into a state fully coupled with the lamp house 30. The button body 10 and the diffuser sheet 20 are detachable from the lamp house 30, and hence they can be replaced after assembly. Further, for reinforcement, the upper surface 30*f* of the lamp house 30 and the diffuser sheet 20, and the diffuser sheet 20 and the button body 10 may be bonded to each other by an adhesive, though this makes replacement after assembly difficult to carry out.

Further, the lamp house 30 is formed integrally with a fitting part (coupling part) 30*c,* two guide pins 30*d,* and two guide ribs (sliding contact part) 30*e* (see FIG. 2). The lamp house 30 has a cavity CA as an opposed part, formed in a central portion thereof, which is defined by four surrounding side walls 30*g* (see FIG. 2, FIG. 3C). The cavity CA and the button body 10 form a light transmissive part. The fitting part 30*c* is formed on a switch unit US side of the lamp house 30, and has formed therein a square fitting hole 30*ca* for being fitted on the head part 52*a* of the driven part 52 of the switch unit US. Further, the fitting part 30*c* is formed therein with a slit 30*cb,* and when the head part 52*a* of the driven part 52 is fitted in the fitting part 30*c,* it is detachably held in the fitting hole 30*ca* due to appropriate resilience of the slit 30*cb.* When the head part 52*a* is fitted in the fitting hole 30*ca,* a lower face 30*cc* of the fitting part 30*c* is brought into abutment with the contact surface 52*b,* which inhibits still deeper engagement of the lamp house 30 with the driven part 52. As a result, a pressing force is positively transmitted from the lamp house 30 to the driven part 52. This causes the driven part 52 and the lamp house 30 to move up or down in an interlocked manner, with the driven part 52 and the lamp house 30 mutually coupled by frictional forces therebetween.

Further, the lamp house 30 has a plurality of (four) stopper parts ST extending vertically downward therefrom as shown in FIGS. 1 and 3C. The stopper parts ST are brought into abutment with the substrate 60 when the pushbutton unit UB is depressed, thereby setting a limit to a depression-terminating position (fully-depressed position) of the pushbutton unit UB.

The guide pins 30*d* extend downward and are fitted through the respective guide holes 60*c* of the substrate 60. As the pushbutton unit UB is moved up and down, the guide pins 30*d* slide within the respective guide holes 60*c* to thereby guide the motion of the pushbutton unit UB. The two guide ribs 30*e* are formed in opposed relation to a vertical surface 51*a* (see FIG. 3C) of the switch unit US. The vertical surface 51*a* of the switch unit US extend almost perpendicularly to the substrate 60, and when the driven part 52 is fitted in the fitting part 30*c,* respective sliding surfaces 30*ea* of the guide ribs 30*e* are brought into snug contact with the vertical surface 51*a* (see FIG. 3C). Further, as the pushbutton unit UB is moved up and down, the respective sliding surfaces 30*ea* of the guide ribs 30*e* slide on the vertical surface 51*a,* which also guide the motion of the pushbutton unit UB.

The cavity CA surrounded by the side walls 30*g* expands upward, i.e. toward the push-down member with indicator, and the lamp house 30 is white, so that light from the LED 40 is reflected in the cavity CA and efficiently guided toward the button body 10. This makes it possible to enhance efficiency in gathering light from the LED 40, thereby improving visibility of the light through the depressing part 10*b.*

The cavity CA is substantially larger in diameter than the LED 40, and when the lamp house 30 is mounted to the substrate, the cavity CA is opposed to the LED 40. While the depressing part 10*b* is depressed and released to cause the pushbutton unit UB to move up and down, the LED 40 is inserted relatively deeper and withdrawn to a predetermined position in the cavity CA. Therefore, the height from the substrate 60 to the upper end of the depressing part 10*b* can be set low, which contributes to reduction of the thickness of the illuminated switch LSW. Moreover, since the LED 40 is inserted deeper into the cavity CA as the depressing part 10*b* is depressed deeper, the visibility of light through the depressing part 10*b* is further enhanced. Further, while the depressing part 10*b* is depressed, as the LED 40 is inserted deeper into the cavity CA, the height from the substrate 60 to the top of the lump house 30 represented by H11 is lower. When the depressing part 10*b* is fully depressed, the height from the substrate 60 to the top of the lump house 30 reachs a height represented by H12 (see FIG. 5A). That is, as the depressing part 10*b* is depressed deeper, the pushbutton unit UB is more stabilized. In the illuminated switch LSW, the pushbutton unit UB as a moving means is guided by a guide means which is comprised of holes and so forth provided on the substrate 60 on which many electric component parts are mounted. As a result, a switch construction having excellent operability (especially, smooth switching operation), while the illuminated switch can be compact in size, without requiring a special guide means.

Figure 5A:
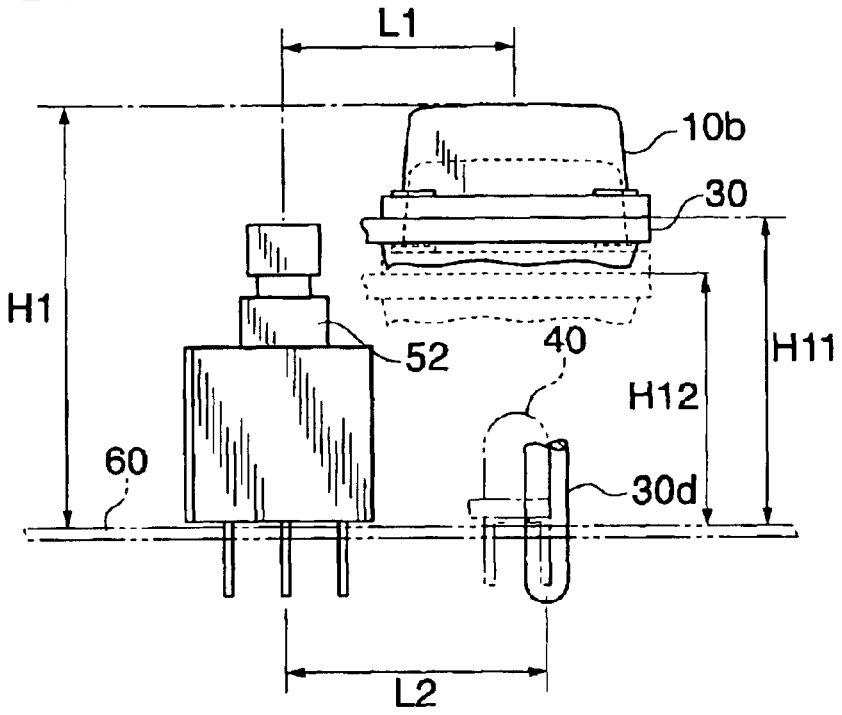
FIG. 5A is a schematic view illustrating the positional relationship between main component parts of the illuminated switch of the first embodiment.
Figure 5B:
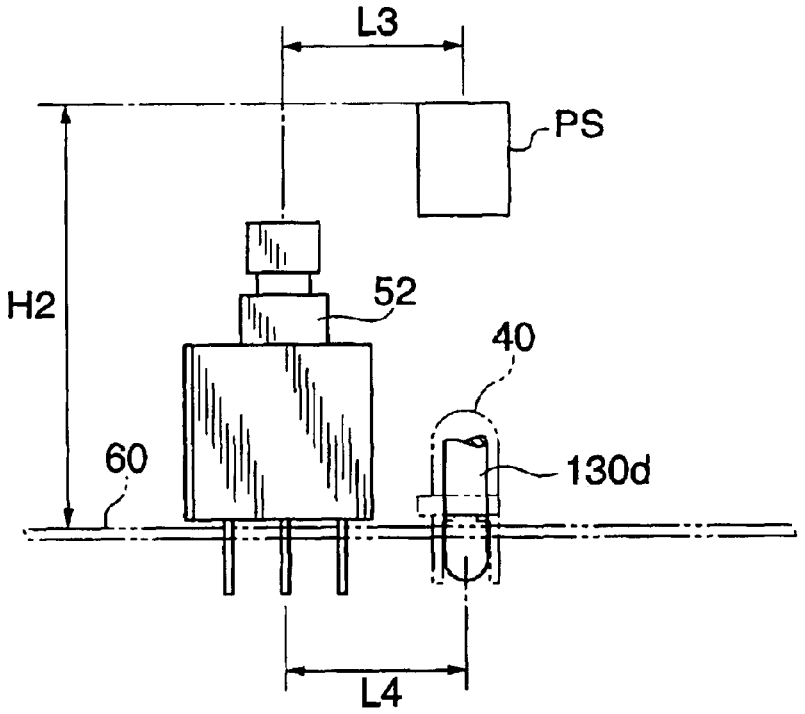
FIG. 5B is a schematic view illustrating the positional relationship between main component parts of the illuminated switch of the second embodiment.

FIG. 5A is a schematic view illustrating the positional relationship of main component parts of the illuminated switch LSW of the present embodiment. FIG. 5A shows relative positions of the main component parts of the illuminated switch LSW as viewed from a right side in FIG. 3A. FIG. 5B will be referred to hereinafter.

As shown in FIG. 5A, it is assumed that the distance from the center of the driven part 52 of the switch unit US to the center of the depressing part 10*b* of the button body 10 is represented by L1, the distance from the center of the driven part 52 to the center of the guide pin 30*d* of the lamp house 30 by L2, and the height from the substrate 60 to the top of the depressing part 10*b* by H1. In the present embodiment, the distance L1 is set to approximately 12 mm, the distance L2 to approximately 13.5 mm, and the height H1 to approximately 20 mm. The LED 40 is disposed at a location substantially below the center of the depressing part 10*b.*

The illuminated switch LSW is mounted on the substrate 60 in the following manner (see FIGS. 2, 3):

First, the diffuser sheet 20 and the button body 10 are mounted on the lamp house 30 with the cutouts 20*a* of the diffuser sheet 20 and the slots 10*c* of the button body 10 aligned with the projections 30*a* of the lamp house 30, to thereby complete the pushbutton unit UB. On the other hand, the switch unit US and the LED 40 are attached to the substrate 60 by passing the terminals 53 of the switch unit US and the terminals 41 of the LED 40 through the respective terminal holes 60*a,* 60*b* of the substrate 60 such that the terminals 53, 41 are projected downward from the substrate 60, and then soldering the terminals 53 and 41 to the substrate 60 using a soldering bath, not shown, or manual soldering whereby the switch unit US and the LED 40 are fixed to the substrate 60. Then, the guide pins 30*d* are passed through the respective guide holes 60*c* of the substrate 60 with the cavity CA disposed in opposed relation to the LED 40, and the head part 52*a* of the driven part 52 of the switch unit US is fitted into the fitting hole 30*ca* of the fitting part 30*c.*

Alternatively, the pushbutton unit UB and the switch unit US may be combined (by fitting the head part 52*a* into the fitting part 30*c*) before attachment of the switch unit US to the substrate 60. In this case, after the LED 40 is attached to the substrate 60, the combined pushbutton unit UB and switch unit US is attached to the substrate 60.

After the illuminated switch LSW is attached to the substrate 60, the panel 70 is placed on the illuminated switch LSW as shown in FIGS. 3B, 3C. In this case, the substrate 60 having illuminated switches LSW mounted thereon may be fixed to the panel 70. The panel 70 has a plurality of holes 70*a* formed therethrough in association with a plurality of illuminated switches LSW, and each hole 70*a* allows only the upper half portion of a corresponding depressing part 10*b* to pass therethrough and be projected upward from the panel 70.

In the illuminated switch LSW constructed as above, when the operator depresses the depressing part 10*b* of the pushbutton unit UB, the pressing force is transmitted to the driven part 52 via the fitting part 30*c,* whereby the driven part 52 sinks to be locked in its "ON" position. On this occasion, even when the driven part 52 sinks to its deepest position (i.e. a position in which the pushbutton unit UB is fully depressed to cause the stopper part ST to abut on the substrate 60), a clearance is maintained between the lower face 30*cc* of the fitting part 30*c* and the upper surface 51*b* of the switch body 51. As the driven part 52 moves downward, the guide pins 30*d* slide within the respective guide holes 60*c,* and the sliding surfaces 30*ea* of the respective guide ribs 30*e* slide in contact with the vertical surface 51*a,* so that the pushbutton unit UB is guided to move straight down smoothly.

When the driven part 52 reaches its "ON" position, the LED 40 is lit, and the operator can see light from the LED 40 through the cavity CA, the diffuser sheet 20 and the transparent depressing part 10*b*. The light is diffused by the diffuser sheet 20, so that the light can be visually recognized with ease from any angle over a wide angle range, and letters, such as "ON", printed on the diffuser sheet 20 can also be clearly recognized. Further, the depressing part 10*b* of the button body 10 has a solid transparent body extending from the top surface to the portion in contact with the diffuser sheet 20, and therefore, the letters or the like on the diffuser sheet 20 are easy to recognize due to the refractive index of the solid transparent body. Furthermore, if the depressing part 10*b* is configured in a convex shape, a lens effect can be also provided.

On the other hand, when the operator depresses the depressing part 10*b* in its "ON" state, the upward returning force of the driven part 52 is transmitted to the pushbutton unit UB via the fitting part 30*c,* which causes the pushbutton unit UB to move upward in a manner interlocked with the driven part 52 to its "OFF" position where it is stopped. Also on this occasion, the pushbutton unit UB moves upward smoothly while being guided by the guide holes 60*c,* the guide pins 30*d,* the sliding surfaces 30*ea* and the vertical surface 51*a*.

According to the present embodiment, the driven part 52 is fitted in the fitting part 30*c,* whereby the pushbutton unit UB is held by the driven part 52 and brought into a state in which the pushbutton unit UB can perform reciprocating motion in a manner interlocked with the driven part 52. Further, not only the guide holes 60*c* and the guide pins 30*d,* but also the sliding surface 30ea and the vertical surface 51*a* cooperate with each other to positively perform the guiding function during reciprocating motion of the pushbutton unit UB. Therefore, it is not required to additionally provide a holding member, such as a guide frame, and fix the same to the substrate 60 or the panel 70 so as to hold and guide the pushbutton unit UB, which makes it possible to simplify the construction of the illuminated switch LSW, thereby reducing the size of the same and suppressing an increase in manufacturing costs. Further, since the motion of the pushbutton unit UB is made smooth, excellent button operability is maintained. Thus, the illuminated switch construction according to the present embodiment is compact in size, cost-reduced and simple in structure, and makes it possible to ensure excellent visibility and operability of the illuminated switch.

Further, according to the present embodiment, by providing a plurality of types of button bodies 10 and a plurality of types of diffuser sheets 20, different types of illuminated switch assemblies can be formed by selectively combining the button bodies 10 and the diffuser sheets 20, it is possible to obtain numerous types of illuminated switch assemblies from a limited number of types of component parts.

Furthermore, the guiding function provided by the guide holes 60*c* and the guide pins 30*d* also serves to guide the driven part 52 for reciprocating motion, which makes it possible to ensure smooth switching operation of the switch unit US.

Moreover, since the depressing part 10*b* can be configured in a minimum required size, whichever portion of the depressing part 10*b* is depressed, the pushbutton unit UB is properly guided. Further, since the guide pins 30*d* and the guide ribs 30*e* are disposed at respective two pairs of different locations in the horizontal direction in which the substrate 60 lies, the motion of the pushbutton unit UB is guided in the horizontal direction by these parts at the four locations. In addition, since each of the guide pins 30*d* and the guide ribs 30*e* has a sufficient length in the vertical direction, the pushbutton unit UB is guided three-dimensionally by the guiding function of these parts. This further stabilizes the switching motion.

Although in the above described embodiment, the switch mechanism includes the LED 40 as an essential component part, the pushbutton unit UB and the switch unit US may also be used in a switch mechanism which does not include the LED 40. This enables common use of component parts of the illuminated switch, which promises reduction of manufacturing costs.

Next, a second embodiment of the present invention will be described.

Figure 4:
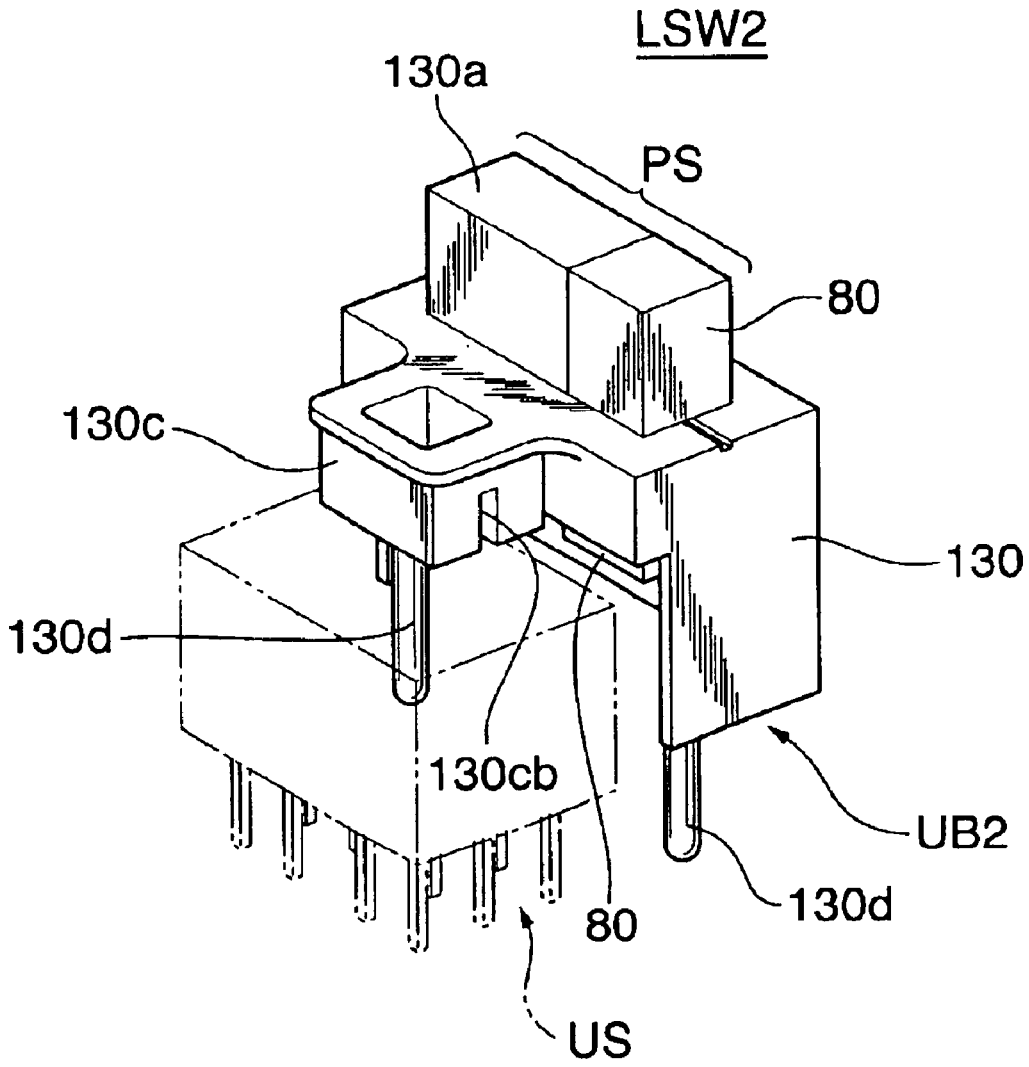
FIG. 4 is a perspective view of a pushbutton unit of an illuminated switch having an illuminated switch construction according to a second embodiment of the present invention.

FIG. 4 is a perspective view of a pushbutton unit of an illuminated switch having an illuminated switch construction according to a second embodiment of the present invention. The illuminated switch LSW2 having the illuminated switch construction according to the second embodiment is comprised of a switch unit US and the pushbutton unit UB2. In the present embodiment, the switch unit US has the same construction as that of the first embodiment. An LED 40 (see FIG. 5B) also has the same construction as that of the LED 40 of the first embodiment. However, the pushbutton unit UB2 is different in construction from the pushbutton unit UB of the first embodiment.

The pushbutton unit UB2 is comprised of a lamp house 130 and a light guide 80, which forms, together with the cavity CA, a light transmissive part. The lamp house 130 is formed of an opaque material having a white color, for example. The lamp house 130 has au upper portion integrally formed with an operating section-forming part 130*a*. The light guide 80 is attached to the lamp house 130 by press-fitting or bonding. The light guide 80 is adjacent to the operating section-forming part 130*a* and has a top surface flush with a top surface of the same. The light guide 80 and the operating section-forming part 130*a* form a depressing part PS. In depressing operation, the depressing part PS corresponds to the depressing part 10*b* of the first embodiment. The LED 40 is disposed below the light guide 80 at a location opposed thereto.

The lamp house 130 is formed integrally with a fitting part 130*c* and two guide pins (guide-engaging parts) 130*d*. The fitting part 130*c* has the same construction as that of the fitting part 30*c* of the first embodiment except that it has a slit 130*cb* formed therein. The guide pins 130*d* are different in position from the guide pins 30*d* of the first embodiment, but identical in structure and function to the guide pins 30*d*. No element is provided which corresponds to the guide ribs 30*e*. Although not shown, similarly to the substrate of the first embodiment, a substrate of the present embodiment is formed therein with terminal holes and guide holes corresponding to terminals of the LED 40 and the guide pins 130*d* in addition to terminal holes corresponding to terminals of the switch unit US.

Switching operation performed by the illuminated switch LW2 of the present embodiment is similar to that of the illuminated switch LW of the first embodiment, except for the absence of the guiding function performed by the guide ribs 30*e*. Further, light from the LED can be visually recognized through the light guide 80.

FIG. 5B is a schematic view illustrating the positional relationship between main component parts of the illuminated switch of the second embodiment. FIG. 5B shows relative positions of the main component parts of the illuminated switch LSW2 in the same fashion as FIG. 5A. As shown in FIG. 5B, it is assumed that the distance from the center of the driven part 52 of the switch unit US to the center of the depressing part PS is represented by L3, the distance from the center of the driven part 52 to the center of the guide pin 130*d* of the lamp house 130 by L4, and the height from the substrate 60 to the top of the depressing part PS by H2. In the present embodiment, the distance L3 is set to approximately 7.5 mm, the distance L4 to approximately 7.5 mm, and the height H2 to approximately 20 mm. The LED 40 is disposed, similarly to the LED 40 of the first embodiment, at a location substantially below the center of the depressing part PS.

Comparing between the second embodiment (FIG. 5B) and the first embodiment (FIG. 5A), L3 is shorter than L1, and L4 is shorter than L2, and hence the depressing part PS and the guide pin 130*d* are closer to the switch unit US than the depressing part 10*b* and the guide pin 30*d* are. Further, the depressing part PS has a width (length in the left-right direction as viewed in FIG. 5B) smaller than that of the depressing part 10*b*, and therefore the depression area of the depressing part PS is limited. Further, in the second embodiment, the depressing part PS and the guide pin 130*d* are arranged at approximately the same location in the left-right direction as viewed in FIG. 5B).

These differences enable the pushbutton unit UB2 to be guided properly by the guide pins 130*d* alone when the depressing part PS is depressed, whereby the pushbutton unit UB2 can perform smooth reciprocating motion without the help of guide ribs.

The illuminated switch construction according to the present embodiment is compact in size, cost-reduced and simple in structure, and makes it possible to ensure excellent visibility and operability of the illuminated switch LW2, that is, to obtain the same advantageous effects as provided by the first embodiment. Further, since guide ribs is dispensed with, the illuminated switch has a simplified structure. Moreover, the present embodiment is also advantageous in that a switch unit having no surface corresponding to the vertical surface 51*a* can be adopted.

In this connection, while the first embodiment is advantageous in that the guiding function of the guide ribs 32*e* ensures guidability even when the switch unit US and the LED 40 cannot be arranged close to each other, even in the second embodiment in which the switch unit US and the LED 40 can be arranged close to each other, it is desirable that guide ribs are provided with a view to ensuring a more reliable guiding function.

Although in the second embodiment, the light guide 80 and the operating section-forming part 130*a* of the depressing part PS have their top surfaces flush with each other, this is not limitative, but the light guide 80 may be lower in level than the operating section-forming part 130*a*, for example, and only the operating section-forming part 130*a* may be depressed. Even in this case, since the light guide 80 is extremely close to the operating section-forming part 130*a*, excellent visibility can be ensured.

Further, although in the first and second embodiments, the head part 52*a* of the driven part 52 is held in a fixed state by being fitted in the fitting part 30*c*(130*c*), this is not limitative, but it is possible to employ any mechanism in which the pushbutton unit UB (UB2) and the driven part 52 are fixedly fitted, bonded, or connected such that they can operate in a manner interlocked with each other.

Furthermore, the button body 10 and the light guide 80 have only to allow light to pass therethrough, and therefore, they may be translucent, for example. Further, the LED 40 may be replaced by another light-emitting element or another component part having the function of illuminating the button body 10.

Moreover, the switch unit US may be a switch of a non-lock type.

Further, although the cavity CA and the depressing part 10*b*(PS) are located right above the LED 40, this is not limitative, but if it is arranged such that light from the LED 40 is guided into the depressing part 10*b*(PS) e.g. by a light-reflecting device, a light guide, or an optical fiber, the cavity CA and the depressing part 10*b*(PS) can be shifted from the location right above the LED 40.

In addition, although in the above first and second embodiments, the guide pins 30*d*, 130*d* extending from the pushbutton unit UB, and the guide holes 60*c* formed through the substrate 60 in association with the respective guide pins cooperate with each other to perform the guiding function, the positional relationship between the guide pins and the guide holes may be reversed as employed by a fourth embodiment, described hereinafter. The two kinds of elements for the guiding function are not limited to the combination of a pin and a hole associated therewith. For example, one of the two elements may be a guide and the other a member engaging with the guide.

When the positional relationship between the guide pins and the guide holes is reversed, guide pins may be formed as a chip-shaped component e.g. of a metal, such as zinc, brass or copper, and passed through a substrate by an automatic electronic component-attaching apparatus, not shown, for example, and then the guide pins are erected on the substrate by securing the lower ends of the guide pins projected downward from the substrate to the substrate using an automatic soldering vessel. This processing may be carried out simultaneously with soldering of electronic component parts to the substrate to mount them on the substrate.

In this case, the pushbutton unit UB is formed therein with through holes associated with the respective guide pins. If the guide pins are formed of resin, they may be bonded to the substrate. In this case, the lower ends of the guide pins projected downward from the substrate may be used for positioning.

Next, a third embodiment of the present invention will be described.

In the third embodiment, illuminated switches LSW of the first embodiment and illuminated switches LSW2 of the second embodiment are arranged together on a substrate. Further, the third embodiment is distinguished from the first and second embodiments, in which the guide holes are formed through the substrate, in that guide members 90 formed separately from the substrate are mounted on the substrate, whereby guide holes similar to the guide holes 60*c* are provided.

Figure 6:
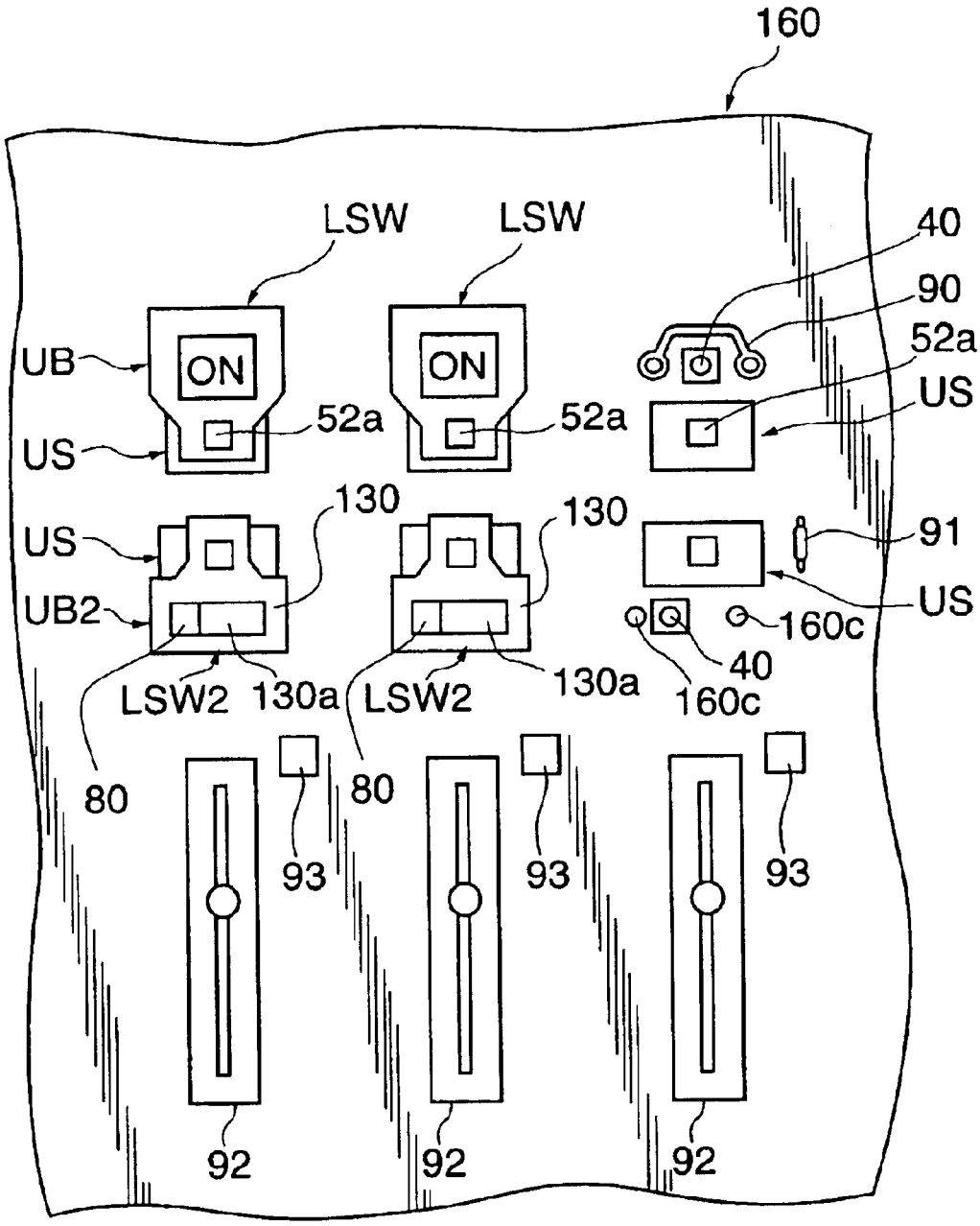
FIG. 6 is a top plan view showing a portion of a substrate on which are arranged illuminated switches some of which have an illuminated switch construction according to a third embodiment of the present invention.
Figure 7:
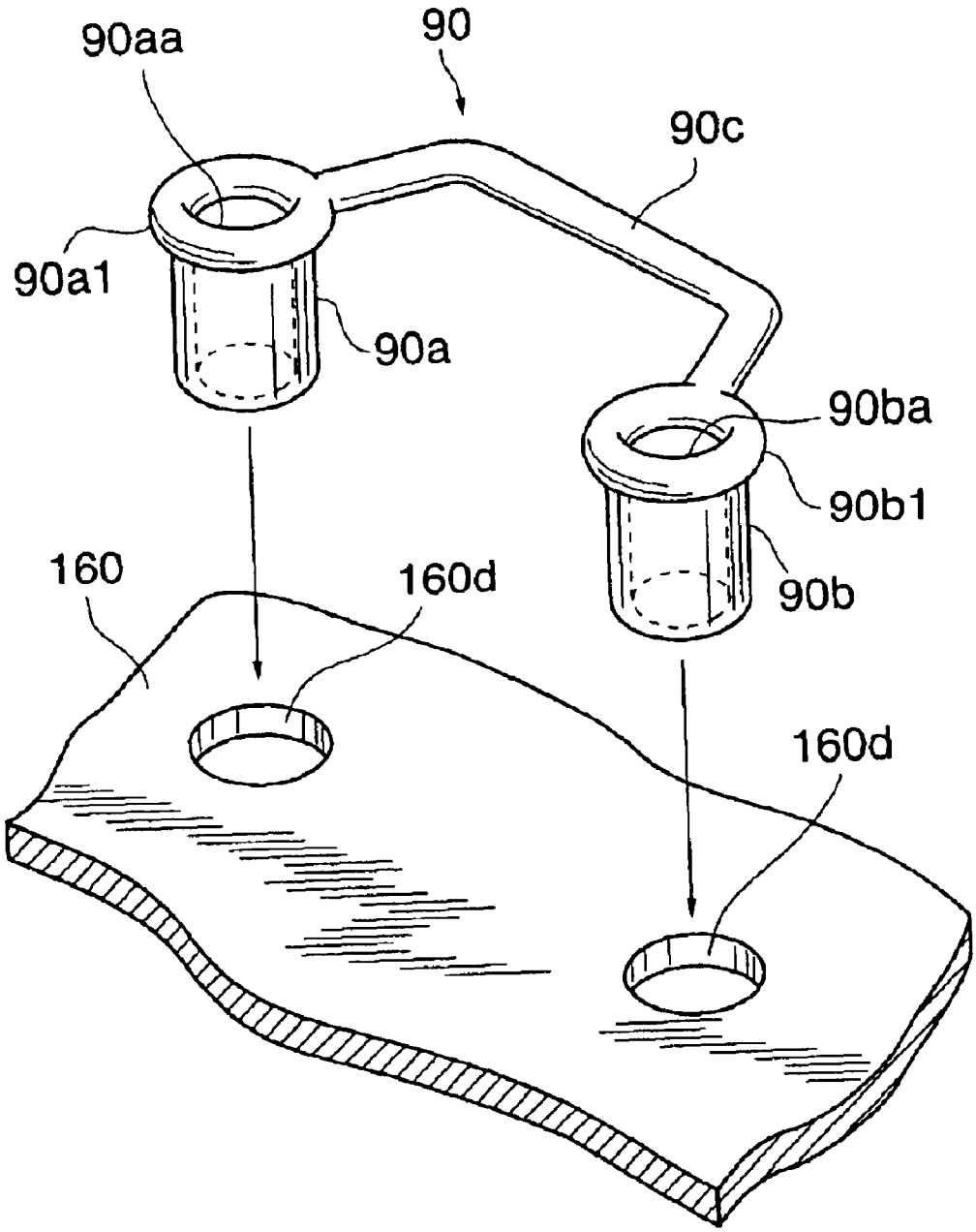
FIG. 7 is a perspective view showing a guide member and an associated portion of the substrate.

FIG. 6 is a top plan view showing a portion of a substrate on which are arranged illuminated switches having an illuminated switch construction according to a third embodiment of the present invention. FIG. 7 is a perspective view showing only one of the guide members 90 and an associated portion of the substrate 160.

As shown in FIG. 6, on the substrate 160, there are arranged not only a plurality of illuminated switches LSW, LSW2, but also a plurality of electric component parts, such as resistors 91, slide switches 92 as faders for setting volume and other parameters, and other switches 93. Further, although not shown, electric component parts, such as ICs (Integrated Circuits), LSIs (Large Scale Integrated circuits) and capacitors, are arranged on the upper and lower surfaces of the substrate 160. In short, the substrate 160 is implemented by a commercially available general-purpose substrate or board as a base member for general electric component parts, on which, in the present embodiment, the various electric component parts and the illuminated switches LSW, LSW2 are arranged.

The substrate 160 is formed therein with guide holes 160*c* similar to the guide holes 60*c* of the first embodiment, which are used as guide means for illuminated switches LSW2 as described in the second embodiment, and there are also provided LEDs 40 on the substrate 160. On the other hand, guide means for illuminated switches LSW are implemented not by the guide holes 160*c*, but by the guide members 90.

As shown in FIG. 7, the guide members 90 are formed e.g. of resin, as one-piece members each having two holed insertion pins (guide parts) 90*a*, 90*b* connected by a connecting part 90*c*. The substrate 160 is formed therein with holes 160*d*, 160*d* associated with the respective holed insertion pins 90*a*, 90*b*, and the pins 90*a* are fitted in the holes 160*d*, 160*d*. The holed insertion pins 90*a*, 90*b* are formed therein with guide holes 90*aa*, 90*ba*, respectively. When the holed insertion pins 90*a*, 90*b* are passed through the holes 160*d*, 160*d*, the guide holes 90*aa*, 90*ba* are positioned at respective locations corresponding to the guide holes 60*c* of the first embodiment in the horizontal direction in which the substrate 160 lies. Further, the connecting part 90*c* is held in contact with the substrate 160 together with collar parts 90*a*1, 90*b*1, thereby preventing the guide member 90 from rattling. With a view to fixing the guide member 90 firmly, it is desired that the holed insertion pins 90*a*, 90*b* are fixedly fitted in the holes 160*d*, 160*d* by press-fitting or bonding.

The guide hole 90*aa* (90*ba*) has approximately the same inner diameter as that of the guide hole 60*c*. Therefore, similarly to the guide pins 130 of the second embodiment, the guide pins 30*d* of the lamp house 30 fitted through the respective guide holes 90*aa*, 90*ba* slide therein in accordance with reciprocating motion of the pushbutton unit UB, whereby the motion of the pushbutton unit UB is guided. In particular, since the guide hole 90*aa*(90*ba*) is longer than the guide hole 60*c* in the longitudinal direction thereof, the three-dimensional guiding is made more reliable, which ensures excellent guidability for reciprocation of the pushbutton unit UB over a wider range.

The illuminated switch construction according to the present embodiment is compact in size, cost-reduced, and simple in structure, and makes it possible to ensure excellent visibility and operability of the illuminated switch LSW, i.e. to obtain the same advantageous effects as provided by the first embodiment. Further, since the guide members 90 and the substrate 160 are formed as separate members, it is possible to easily set the shape and length of the guide holes 90*aa*, 90*ba* such that the guidability thereof is enhanced, thereby ensuring excellent guidability over a wider range and improving the switching operation of the illuminated switch.

Incidentally, if the accuracy of positioning the head part 52*a* of the driven part 52 with respect to the switch body 51 can be enhanced, it is possible to obtain a sufficient guiding function even without using the guide member 90, and hence it is more desirable that the guide holes 60*c* are formed in the same manner as in the first embodiment in which the guide member 90 is not required, to thereby simplify the construction of the switch LSW.

Further, although in the present embodiment, the guide member 90 is provided only for the illuminated switch LSW similar to that of the first embodiment, and the guide means for the illuminated switch LSW2 is implemented by the guide holes 160*c* similar to the guide holes 60*c* of the first embodiment, the guide member 90 may also be applied to the illuminated switch LSW2, and the illuminated switch LSW2 may be disposed in association therewith.

Next, the fourth embodiment of the present embodiment will be described.

In the fourth embodiment, a guide member formed separately from a substrate is mounted on the substrate, and at the same time, the positional relationship between guide pins and guide holes is reversed to that of the first to third embodiments.

Figure 8:
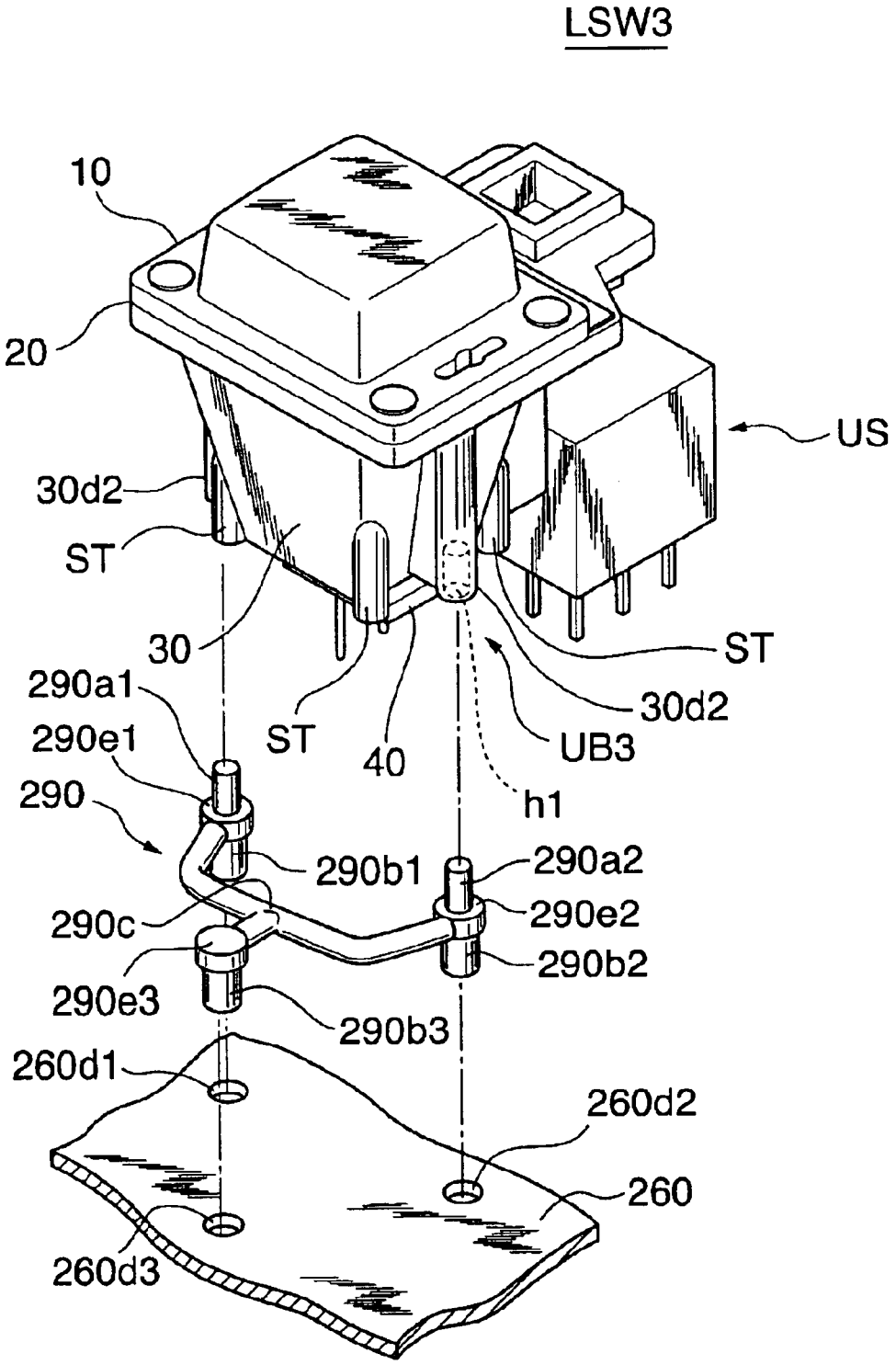
FIG. 8 is a perspective view showing one illuminated switch having an illuminated switch construction according to a fourth embodiment of the present invention, and a guide member and a portion of a substrate associated therewith.

FIG. 8 is a perspective view showing an illuminated switch having an illuminated switch construction according to the fourth embodiment, and a guide member and a portion of the substrate associated therewith.

The illuminated switch LSW3 of the fourth embodiment is comprised of a switch unit US and a pushbutton unit UB3. The switch unit US employed in the present embodiment has the same construction as that of the first embodiment. An LED 40 is used, which also has the same construction as that of the first embodiment. The pushbutton unit UB3 is different in construction from that of the first embodiment.

Further, as guide means for the illuminated switch LSW3, not the guide holes 60*c* but a guide member 290 is used. The substrate 260 is implemented by a general-purpose substrate.

The pushbutton unit UB3 is different from the pushbutton unit UB of the first embodiment in that the two guide pins 30*d* are replaced by two holed guided parts 30*d*2. Each of the holed guided parts 30*d*2 is shorter than the guide pin 30*d*, and is formed therein with a guide hole (guide-engaging part) h1 that opens downward. The construction of the pushbutton unit UB3 is similar to that of the pushbutton unit UB except for the holed guided parts 30*d*2.

The guide member 290 is a one-piece member formed e.g. of resin, and trifurcated into branched end portions from a connecting part 290*c* thereof. Each of the branched end portions has a downwardly extending leg 290*b* (290*b*1, 290*b*2, 290*b*3). Two of the branched end portions corresponding to the legs 290*b*1, 290*b*2 have respective upwardly extending pins 290*a* (290*a*1, 290*a*2).

The substrate 260 is formed therein with three holes 260*d* (260*d*1, 260*d*2, 260*d*3) associated with the respective legs 290*b*1, 290*b*2, 290*b*3 of the guide member 290, through which these legs are fitted. When the legs 290*b* of the guide member 290 are fitted through the respective associated holes 260*d*, the connecting part 290*c* is held in contact with the substrate 260 together with collar parts 290*e* (290*e*1, 290*e*2, 290*e*3) formed integrally on the upper ends of the respective legs 290*b*1, 290*b*2, 290*b*3, whereby the position of the guide member 290 in the vertical direction is positively determined.

The pins 290*a* are each configured to have a shape and an outer diameter which allow the pin 290*a* to slide within the guide hole h1 of the associated holed guided part 30*d*2. Therefore, when the pins 290*a* are inserted into the respective associated guide holes h1, the pins 290*a* slide within the guide holes h1 in accordance with reciprocating motion of the pushbutton unit UB3, whereby the motion of the pushbutton unit UB3 is guided. In short, the pins 290*a* and the guided parts 30*d*2 cooperate with each other to perform the guiding function of guiding the motion of the pushbutton unit UB3.

Similarly to the pushbutton unit UB of the first embodiment, the pushbutton unit UB3 has its fully-depressed position limited by abutment of stopper parts ST on the substrate 260. The length of the holed guided parts 30*d*2 is set such that when the stopper parts ST abut on the substrate 260, a slight clearance is created between the holed guided parts 30*d*2 and the collar parts 290*e*1, 290*e*2.

The guide member 290 is supported at three points by the three legs 290*b*, and hence held on the substrate 260 more stably than the guide member 90 of the third embodiment. As a result, the inclination of the pins 290*a*1, 290*a*2 with respect to the substrate 260 in the vertical direction is reduced, which enhances guidability.

The illuminated switch construction according to the present embodiment is compact in size, cost-reduced and simple in structure, and makes it is possible to ensure excellent visibility and operability of the illuminated switch as well as to ensure excellent guidability over a wider range and improve switching operation of the illuminated switch, i.e. to obtain the same advantageous effects as provided by the third embodiment.

In the above described embodiments, if excellent visibility is not required, the light-emitting element, such as the LED 40, or the light-transmitting part, such as the button body 10 or the light guide 80 may be omitted.

It should be noted that in the above descrived embodiments, the switch unit us may be provided on the substrate 60, 160, or 260 via a socket or the like, and the LED 40 may be provided on the substrate 60, 160, or 260 via a socket socket or the like.

What is claimed is:

1. An illuminated switch construction comprising:

a substrate having at least one guide hole formed therein;

a switch unit provided on said substrate, said switch unit having a driven part driven for reciprocating motion;

a light-emitting device provided on said substrate at a location adjacent to said switch unit; and a pushbutton unit that drives said switch unit, said pushbutton unit having an opposed part disposed in opposed relation to said light-emitting device, a depressing part disposed in association with said opposed part, for depressing operation, said depressing part allowing light from said light-emitting device to pass therethrough, a coupling part coupled to said driven part of said switch unit to interlock said driven part and said pushbutton unit for reciprocating motion, and at least one guide pin fitted through a corresponding one of said at least one guide hole of said substrate to cooperate with said corresponding guide hole to perform a guiding function of guiding the reciprocating motion of said pushbutton unit.

2. An illuminated switch construction as claimed in claim 1, wherein:

said switch unit has a vertical surface substantially perpendicular to said substrate; and said pushbutton unit has a sliding contact part that is disposed for sliding contact with said vertical surface of said switch unit in accordance with the reciprocating motion of said pushbutton unit; and said vertical surface of said switch unit and said sliding contact part of said pushbutton unit cooperate with each other to perform the guiding function together with the guide hole and the guide pin, for guiding the reciprocating motion of said pushbutton unit.

3. A pushbutton unit for an illuminated switch fixed on a substrate having at least one guide hole formed therein, said pushbutton unit being operated for driving a switch unit having a driven part that is driven for reciprocating motion, comprising:

an opposed part disposed in opposed relation to a light-emitting device provided on the substrate at a location adjacent to the switch unit;

a depressing part disposed in association with said opposed part, for depressing operation, said depressing part allowing light from the light-emitting device to pass therethrough;

a coupling part coupled to the driven part of the switch unit to interlock the driven part and the pushbutton unit for reciprocating motion; and at least one guide pin fitted through a corresponding one of the at least one guide hole of the substrate to cooperate with the corresponding guide hole to perform a guiding function of guiding the reciprocating motion of the pushbutton unit.

4. A pushbutton unit for an illuminated switch as claimed in claim 3, further comprising a sliding contact part disposed for sliding in contact with a vertical surface of the switch unit in accordance with the reciprocating motion of the pushbutton unit, and wherein said sliding contact part cooperates with the vertical surface to perform the guiding function together with the guide hole and the guide pin, for guiding the reciprocating motion of the pushbutton unit.

5. An illuminated switch construction comprising:

a substrate having at least one guide part;

a switch unit provided on said substrate, said switch unit having a driven part that is driven for reciprocating motion;

a light-emitting device provided on said substrate at a location adjacent to said switch unit; and a pushbutton unit that drives said switch unit, said pushbutton unit having an opposed part disposed in opposed relation to said light-emitting device, a depressing part disposed in association with said opposed part, for depressing operation, said depressing part allowing light from said light-emitting device to pass therethrough, a coupling part coupled to said driven part of said switch unit to interlock said driven part and said pushbutton unit for reciprocating motion, and at least one guide-engaging part engaged with a corresponding one of said at least one guide part of said substrate to cooperate with said corresponding guide part to perform a guiding function of guiding the reciprocating motion of said pushbutton unit.

6. An illuminated switch construction, as claimed in claim 5, further comprising at least one guide pin provided on said guide-engaging part, and wherein said guide part has at least one through hole formed therein and extending in a longitudinal direction of said at least one guide pin of said guide-engaging part, said guide pin being fitted through said at least one through hole, said guide part being formed as a separate member from said substrate and fixed to said substrate.

7. An illuminated switch construction comprising:

a substrate having at least one guide part;

a switch unit provided on said substrate, said switch unit having a driven part that is driven for reciprocating motion;

a light-emitting device provided on said substrate at a location adjacent to said switch unit; and a pushbutton unit that drives said switch unit, said pushbutton unit having a pushbutton unit main body and a push-down member with indicator; and said pushbutton unit main body being formed as a one-piece member incorporating an opposed part disposed in opposed relation to said light-emitting device, a coupling part coupled to said driven part of said switch unit to interlock said driven part and said pushbutton unit for reciprocating motion, and at least one guide-engaging part engaged with a corresponding one of said at least one guide part of said substrate to cooperate with said corresponding guide part to perform a guiding function of guiding the reciprocating motion of said pushbutton unit, said push-down member with indicator being disposed on a side of said pushbutton unit main body remote from said substrate and in association with said opposed part of said pushbutton unit main body, said push-down member with indicator having a depressing part for depressing operation, said depressing part allowing light from said light-emitting device to pass therethrough.

8. An illuminated switch construction as claimed in claim 7, wherein said push-down member with indicator includes at least one light diffuser sheet.

9. An illuminated switch construction as claimed in claim 8, wherein said push-down member with indicator is formed by said light diffuser sheet and said depressing part stacked upon said light diffuser sheet on the side of the pushbutton unit main body remote from said substrate.

10. An illuminated switch construction as claimed in claim 9, wherein said depressing part composed of a solid transparent body.

11. An illuminated switch construction as claimed in claim 9, further comprising at least one positioning engaging part provided on said pushbutton unit main body, for aligning said light diffuser sheet and said depressing part stacked upon said light diffuser sheet.

12. An illuminated switch construction comprising:

a substrate having at least one guide part;

a switch unit provided on said substrate, said switch unit having a driven part that is driven for reciprocating motion;

a light-emitting device provided on said substrate at a location adjacent to said switch unit; and a pushbutton unit that drives said switch unit, said pushbutton unit being formed by a combination of a pushbutton unit main body and a push-down member with indicator;

said pushbutton unit main body being formed as a one-piece member incorporating an opposed part disposed in opposed relation to said light-emitting device, a coupling part coupled to said driven part of said switch unit to interlock said driven part and said pushbutton unit for reciprocating motion, at least one guide-engaging part engaged with a corresponding one of said at least one guide part of said substrate to cooperate with said corresponding guide part to perform a guiding function of guiding the reciprocating motion of said pushbutton unit, and a push-down member-mounting part on which one of a plurality of types of push-down member with indicator can be selectively mounted on a side of said pushbutton unit main body remote from said substrate, said push-down member with indicator being disposed on the side of said pushbutton unit main body remote from said substrate and in association with said opposed part of said pushbutton unit main body, said push-down member with indicator having a depressing part for depressing operation, said depressing part allowing light from said light-emitting device to pass therethrough, wherein a desired one of the plurality of types of push-down member with indicator is mounted on said push-down member-mounting part of said pushbutton unit main body, thereby forming one of different types of illuminated switch assemblies.

13. An illuminated switch construction as claimed in claim 12, wherein the push-down member with indicator further comprises at least one of a plurality of types of light diffuser sheets, whereby a plurality of types of the push-down member with indicator can be obtained by selectively combining at least one of the plurality of types of light diffuser sheets with said depressing part; and wherein the selected at least one light diffuser sheet and said depressing part are mounted on said push-down member-mounting part of said pushbutton unit main body in a manner such that the selected at least one light diffuser sheet is stacked upon said depressing part, whereby a desired type of illuminated switch assembly can be obtained.

14. An illuminated switch construction as claimed in claim 12, wherein said push-down member with indicator further comprises at least one light diffuser sheet, whereby a plurality of types of the push-down member with indicator can be obtained by selectively combining one of a plurality of types of depressing parts with said at least one light diffuser sheet; and wherein said at least one light diffuser sheet and the selected depressing part are mounted on said push-down member-mounting part of said pushbutton unit main body in a manner such that the at least one light diffuser sheet is stacked upon the selected depressing part, whereby a desired type of illuminated switch assembly can be obtained.

15. An illuminated switch construction as claimed in claim 12, wherein the push-down member with indicator further comprises at least one of a plurality of types of light diffuser sheets, whereby a plurality of types of the push-down member with indicator can be obtained by selectively combining one of a plurality of types of depressing parts and at least one of the plurality of types of light diffuser sheets; and wherein said at least one light diffuser sheet and the selected depressing part are mounted on said push-down member-mounting part of said pushbutton unit main body in a manner such that the selected at least one light diffuser sheet is stacked upon the selected depressing part, whereby a desired type of illuminated switch assembly can be obtained.

16. An illuminated switch construction as claimed in claim 12, wherein said pushbutton unit main body comprises side walls, and said opposed part comprises a cavity surrounded by said side walls.

17. An illuminated switch construction as claimed in claim 16, wherein said cavity expands toward said push-down member with indicator.

18. An illuminated switch construction as claimed in claim 16, wherein said depressing part and said cavity are disposed such that when during reciprocating motion of said pushbutton unit responsive to depression of said depressing part, at least a portion of said light-emitting device is inserted into said cavity, and as said depressing part is depressed deeper, said light-emitting device is inserted into said cavity to a greater degree.

19. An illuminated switch construction comprising:

a substrate having a plurality of electric components arranged thereon;

at least one guide part fixed on said substrate;

a switch unit provided on said substrate, said switch unit having a driven part that is driven for reciprocating motion;

a light-emitting device provided on said substrate at a location adjacent to said switch unit; and a pushbutton unit that drives said switch unit, said push-button unit having a light transmissive part allowing light from said light-emitting device to pass therethrough, a depressing part for depressing operation, a coupling part coupled to said driven part of said switch unit to interlock said driven part and said pushbutton unit for reciprocating motion, at least one guide-engaging part engaged with a corresponding one of said at least one guide part of said substrate to cooperate with said corresponding guide part to perform a guiding function of guiding the reciprocating motion of said pushbutton unit, wherein reciprocating motion of said driven part is guided by the guiding function performed by said guide part and said guide-engaging part.

20. A switch construction comprising:

a substrate having at least one guide part;

a switch unit provided on said substrate, said switch unit having a driven part that is driven for reciprocating motion; and a pushbutton unit that drives said switch unit, said push-button unit having a depressing part for depressing operation, a coupling part coupled to said driven part of said switch unit to interlock said driven part and said pushbutton unit for reciprocating motion, and at least one guide-engaging part engaged with a corresponding one of said at least one guide part of said substrate to cooperate with said corresponding guide part to perform a guiding function of guiding the reciprocating motion of said pushbutton unit;

said substrate comprising a general-purpose substrate used as a base member for a plurality of electric component parts other than said switch unit, said general-purpose substrate being capable of having said electric component parts and said pushbutton unit arranged thereon;

wherein reciprocating motion of said driven part is guided by the guiding function performed by said guide part and said guide-engaging part.

21. An illuminated switch construction comprising:

a substrate having at least one guide pin fixed thereon;

a switch unit provided on said substrate, said switch unit having a driven part driven for reciprocating motion;

a light-emitting device provided on said substrate at a location adjacent to said switch unit; and a pushbutton unit that drives said switch unit, said push-button unit having an opposed part disposed in opposed relation to said light-emitting device, a depressing part disposed in association with said opposed part, for depressing operation, said depressing part allowing light from said light-emitting device to pass therethrough, a coupling part coupled to said driven part of said switch unit to interlock said driven part and said pushbutton unit for reciprocating motion, and at least one guide hole having a corresponding one of said at least one guide pin fitted therethrough, for cooperating with said corresponding guide hole to perform a guiding function of guiding the reciprocating motion of said pushbutton unit.

* * * * *